US011578422B2

(12) United States Patent
McHugh et al.

(10) Patent No.: US 11,578,422 B2
(45) **Date of Patent: *Feb. 14, 2023**

(54) ELECTROPLATING SYSTEM

(71) Applicant: APPLIED Materials, Inc., Santa Clara, CA (US)

(72) Inventors: Paul R. McHugh, Kalispell, MT (US); Gregory J. Wilson, Kalispell, MT (US); Kyle M. Hanson, Kalispell, MT (US); John L. Klocke, Kalispell, MT (US); Paul Van Valkenburg, Whitefish, MT (US); Eric J. Bergman, Kalispell, MT (US); Adam Marc McClure, Kalispell, MT (US); Deepak Saagar Kalaikadal, Kalispell, MT (US); Nolan Layne Zimmerman, Kalispell, MT (US); Michael Windham, Kalispell, MT (US); Mikael R. Borjesson, Lakeside, MT (US)

(73) Assignee: APPLIED MATERIALS, INC., Santa Clara, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/583,004

(22) Filed: Jan. 24, 2022

(65) Prior Publication Data

US 2022/0145489 A1 May 12, 2022

Related U.S. Application Data

(63) Continuation of application No. 16/870,290, filed on May 8, 2020, now Pat. No. 11,268,208.

(51) Int. Cl.
*C25D 17/12* (2006.01)
*C25D 21/12* (2006.01)
(Continued)

(52) U.S. Cl.
CPC ..... *C25D 17/12* (2013.01); *C25D 5/08* (2013.01); *C25D 7/123* (2013.01); *C25D 17/001* (2013.01); *C25D 17/007* (2013.01); *C25D 21/12* (2013.01)

(58) Field of Classification Search
CPC ..... C25D 7/12–123; C25D 17/001; H01L 21/76873
See application file for complete search history.

(56) References Cited

U.S. PATENT DOCUMENTS 7,247,223 B2 7/2007 McHugh et al.
7,390,382 B2 6/2008 Mchugh et al.
(Continued)

FOREIGN PATENT DOCUMENTS

WO 99-54527 A2 10/1999

OTHER PUBLICATIONS

International Search Report and Written Opinion dated Aug. 13, 2021 for Application No. PCT/US2021/029217, 13 pages.
(Continued)

*Primary Examiner* — Ho-Sung Chung
(74) *Attorney, Agent, or Firm* — Perkins Coie LLP

(57) ABSTRACT

An electroplating system has a vessel assembly holding an electrolyte. A weir thief electrode assembly in the vessel assembly includes a plenum inside of a weir frame. The plenum divided into at least a first, a second and a third virtual thief electrode segment. A plurality of spaced apart openings through the weir frame lead out of the plenum. A weir ring is attached to the weir frame and guides flow of current during electroplating. The electroplating system provides process determined radial and circumferential current density control and does not require changing hardware components during set up.

17 Claims, 7 Drawing Sheets

(51) Int. Cl.

| | |
|---|---|
| ***C25D 5/08*** | (2006.01) |
| ***C25D 7/12*** | (2006.01) |
| ***C25D 17/00*** | (2006.01) |

(56) References Cited

U.S. PATENT DOCUMENTS

| | | | | |
|---|---|---|---|---|
| 7,727,364 | B2 | 6/2010 | Singh et al. | |
| 7,857,958 | B2 | 12/2010 | Mchugh et al. | |
| 7,931,786 | B2 | 4/2011 | Wilson et al. | |
| 8,496,789 | B2 | 7/2013 | Mchugh et al. | |
| 8,496,790 | B2 | 7/2013 | Wilson et al. | |
| 9,099,297 | B2 | 8/2015 | Wilson et al. | |
| 9,222,195 | B2 | 12/2015 | Mchugh et al. | |
| 9,758,897 | B2 | 9/2017 | Wilson et al. | |
| 9,765,443 | B2 | 9/2017 | Wilson et al. | |
| 9,920,448 | B2 | 3/2018 | Mchugh et al. | |
| 10,227,706 | B2 | 3/2019 | Wilson et al. | |
| 10,494,731 | B2 | 12/2019 | Mchugh et al. | |
| 10,577,712 | B2 | 3/2020 | Wilson et al. | |
| 2006/0070883 | A1 | 4/2006 | Bejan et al. | |
| 2010/0032310 | A1* | 2/2010 | Reid | C25D 17/008 205/261 |
| 2012/0258408 | A1* | 10/2012 | Mayer | C25D 17/008 204/229.5 |
| 2013/0327650 | A1 | 12/2013 | Mayer et al. | |
| 2016/0215409 | A1 | 7/2016 | Wilson et al. | |
| 2016/0376722 | A1 | 12/2016 | Mayer et al. | |
| 2017/0051423 | A1 | 2/2017 | Van Valkenburg et al. | |
| 2018/0057955 | A1 | 3/2018 | He et al. | |
| 2019/0177869 | A1 | 6/2019 | Mchugh et al. | |

OTHER PUBLICATIONS

USPTO, Notice of Allowance dated Oct. 28, 2021 for U.S. Appl. No. 16/870,290, 15 pages.

* cited by examiner

ELECTROPLATING SYSTEM

CROSS REFERENCE TO RELATED APPLICATIONS

This application is a continuation of U.S. application Ser. No. 16/870,290, filed May 8, 2020 and now pending, which is incorporated herein by reference in its entirety.

BACKGROUND OF THE INVENTION

Microelectronic devices, such as semiconductor devices, are fabricated on and/or in wafers or workpieces. A typical wafer plating process involves depositing a metal seed layer onto the surface of the wafer via vapor deposition. A photoresist may be deposited and patterned to expose the seed layer. The wafer is then moved into the vessel of an electroplating processor where electric current is conducted through an electrolyte to the wafer, to apply a blanket layer or patterned layer of a metal or other conductive material onto the seed layer. Examples of conductive materials include permalloy, gold, silver, copper, cobalt, tin, nickel, and alloys of these metals. Subsequent processing steps form components, contacts and/or conductive lines on the wafer.

In many or most applications, it is important that the plated film or layer(s) of metal have a uniform thickness across the wafer or workpiece. Some electroplating processors use a current thief, which is an electrode having the same polarity as the wafer. The current thief operates by drawing current away from the edge of the wafer. This helps to keep the plating thickness at the edge of the wafer more uniform with the plating thickness over the rest of the wafer. The current thief may be a physical electrode close to the edge of the wafer. Alternatively the current thief may be a virtual current thief, where the physical electrode is remote from the wafer. In this design, current from the remote physical electrode is conducted through electrolyte to positions near the wafer.

Electroplating processes in wafer level packaging and other applications are diverse with variations in process and wafer patterns. Significant plating non-uniformities often occur along the edge of the wafer pattern. Nonuniformities can be causes by irregularities in the electric field due to pattern variations or by mass-transfer non-uniformities near the wafer edge.

Some electroplating processors use a paddle or an agitator to agitate the electrolyte and increase mass transfer of metal ions in the electrolyte onto the wafer, which can also improve plating uniformity. However, electric field shields in the vessel can protrude between the wafer and the paddle, which can reduce agitation of the electrolyte and degrade plating uniformity near the edges of the wafer. Electric field shields may also have to be removed and replaced with alternative field shields of different sizes to meet the requirements of electroplating different types of wafers. This is time consuming and also requires keeping an inventory of multiple field shields.

Accordingly, engineering challenges remain in designing electroplating processors.

SUMMARY OF THE INVENTION

An electroplating system has a vessel assembly holding an electrolyte. A weir thief electrode assembly in the vessel assembly includes a plenum divided into at least a first and a second virtual thief electrode segment. The plenum has a plurality of spaced apart openings through which thief currents flow to improve the electric field around the edge of the wafer. A weir ring on the weir thief electrode assembly guides the current flow. First and second physical thief electrodes are electrically connected to separate power sources, and are in electrical continuity with the first and second virtual thief electrode segments, respectively.

BRIEF DESCRIPTION OF THE DRAWINGS

In the drawings, the same reference number indicates the same element in each of the views.

DETAILED DESCRIPTION OF THE DRAWINGS

Figure 1:
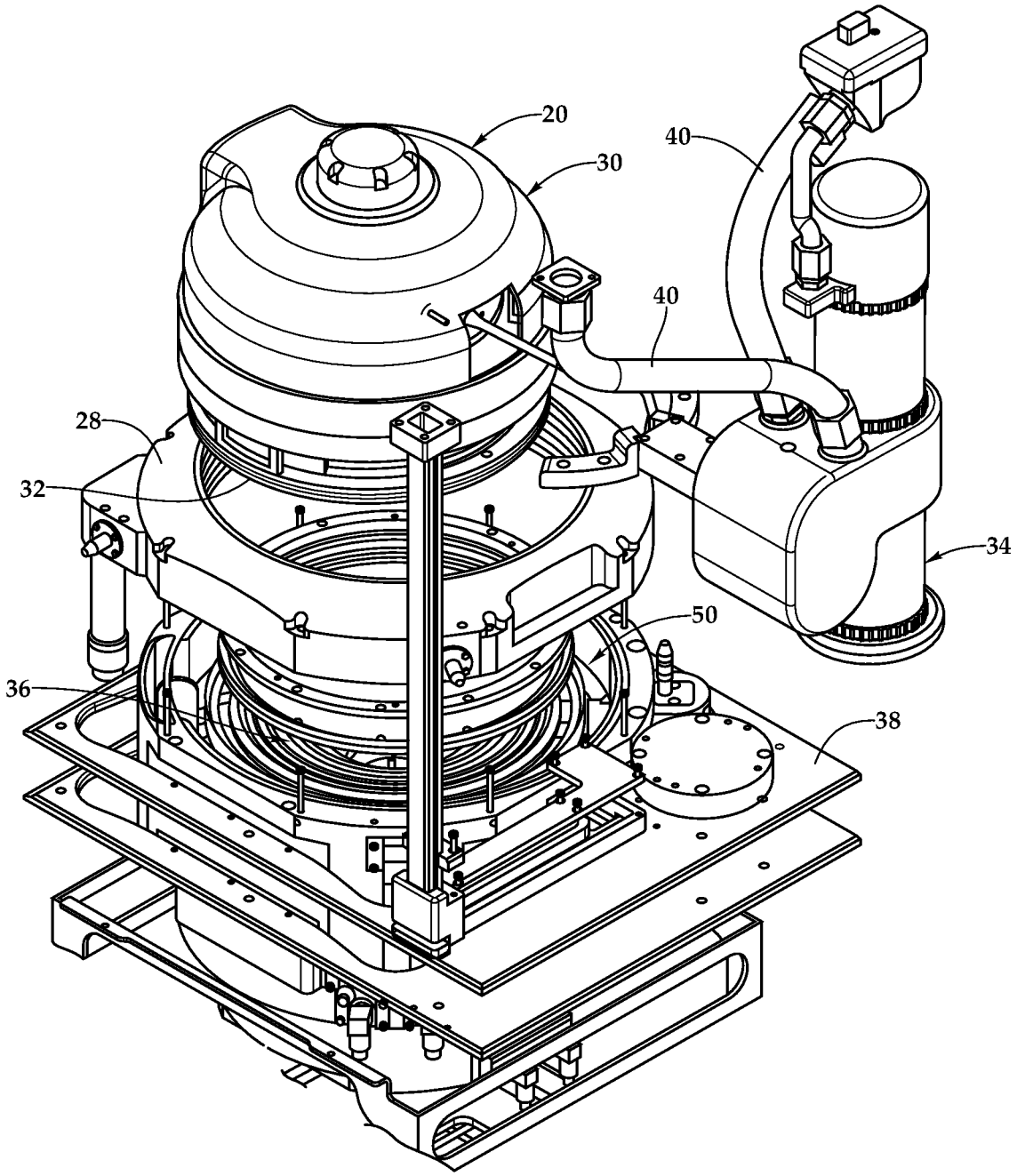
FIG. 1 is an exploded perspective view of an electroplating processor.

FIG. 1 shows an electroplating system 20 having a head 30 positioned above a vessel assembly 36. A single system 20 may be used as a standalone unit. Alternatively, multiple systems 20 may be provided in arrays within an enclosure, with wafers or workpieces loaded and unloaded into and out of the processors by one or more robots. The head 30 may be supported on a lift or a lift/rotate unit 34, for lifting and/or inverting the head to load and unload a wafer into a rotor 32 in the head, and for lowering the head 30 into engagement with the vessel assembly 36 for processing. The rotor 32 has a contact ring which makes electrical contact with a wafer held in the rotor during processing. Electrical control and power cables 40 linked to the lift/rotate unit 34 and to internal head components lead up from system 20 to facility connections, or to connections within multi-processor automated system. A rinse assembly 28 having tiered drain rings may be provided above the vessel frame 50.

Figure 2:
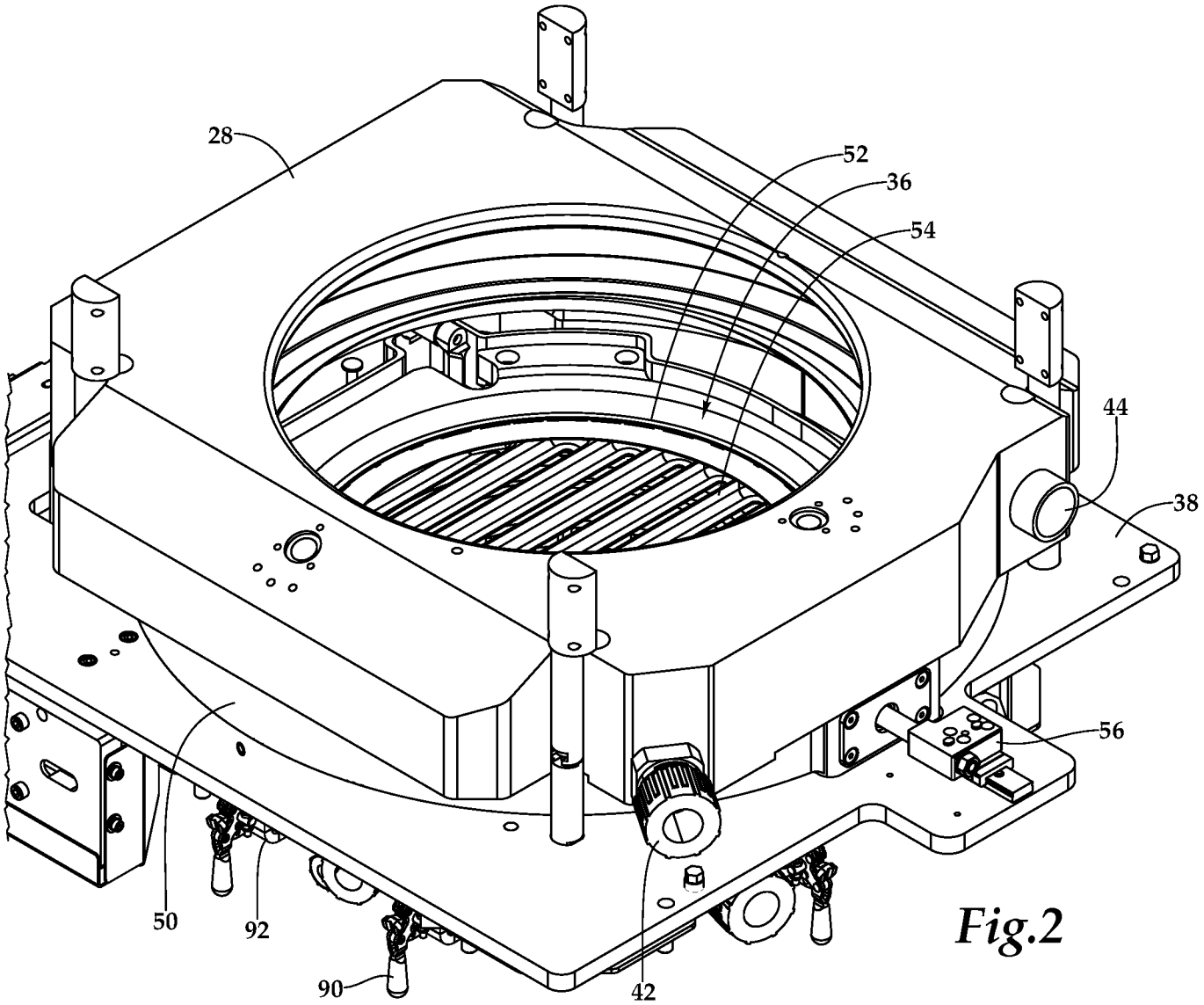
FIG. 2 is a perspective view of the vessel assembly of the electroplating processor shown in FIG. 1.
Figure 3:
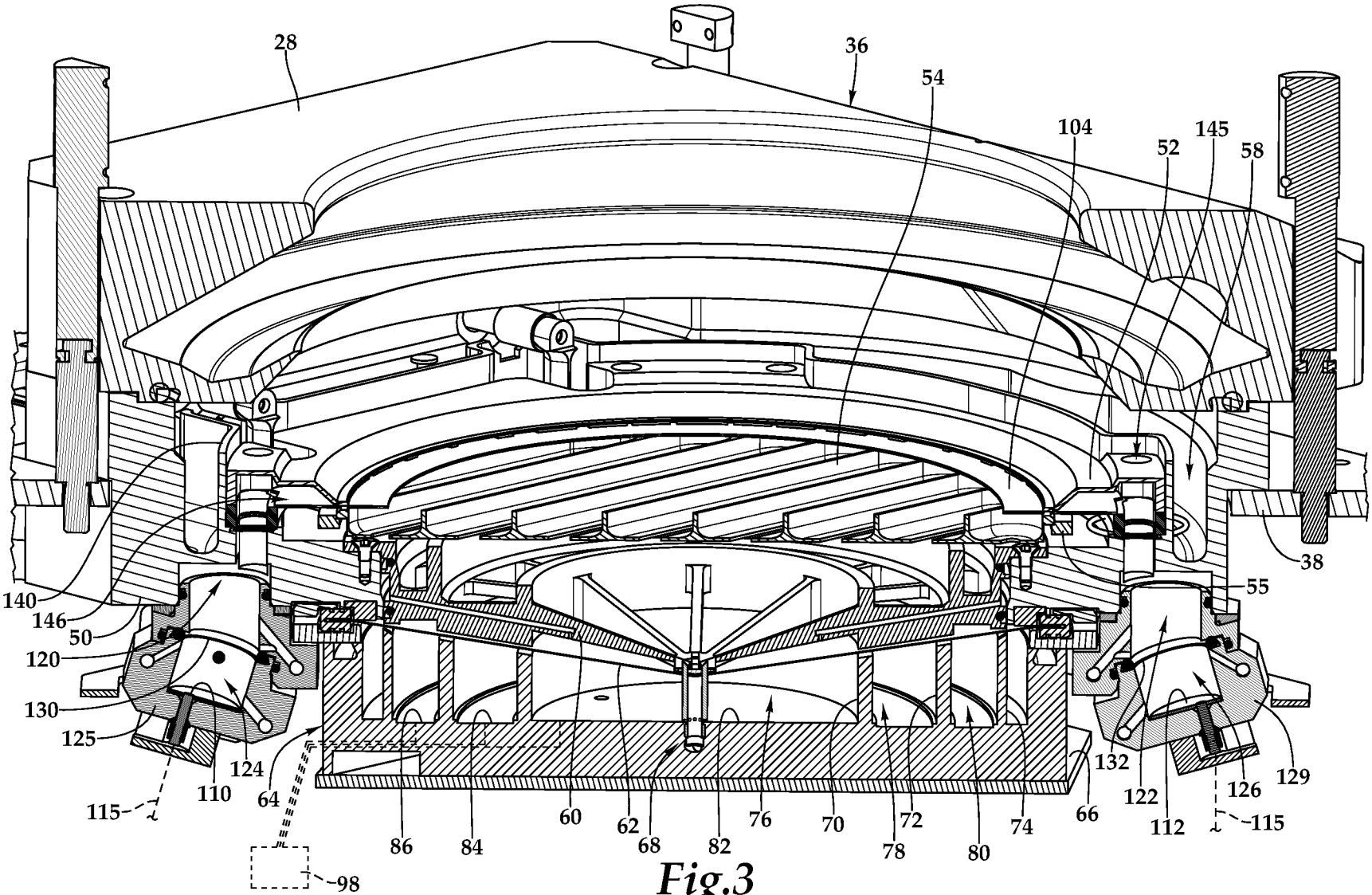
FIG. 3 is a perspective section view of the vessel assembly shown in FIG. 2.
Figure 9:
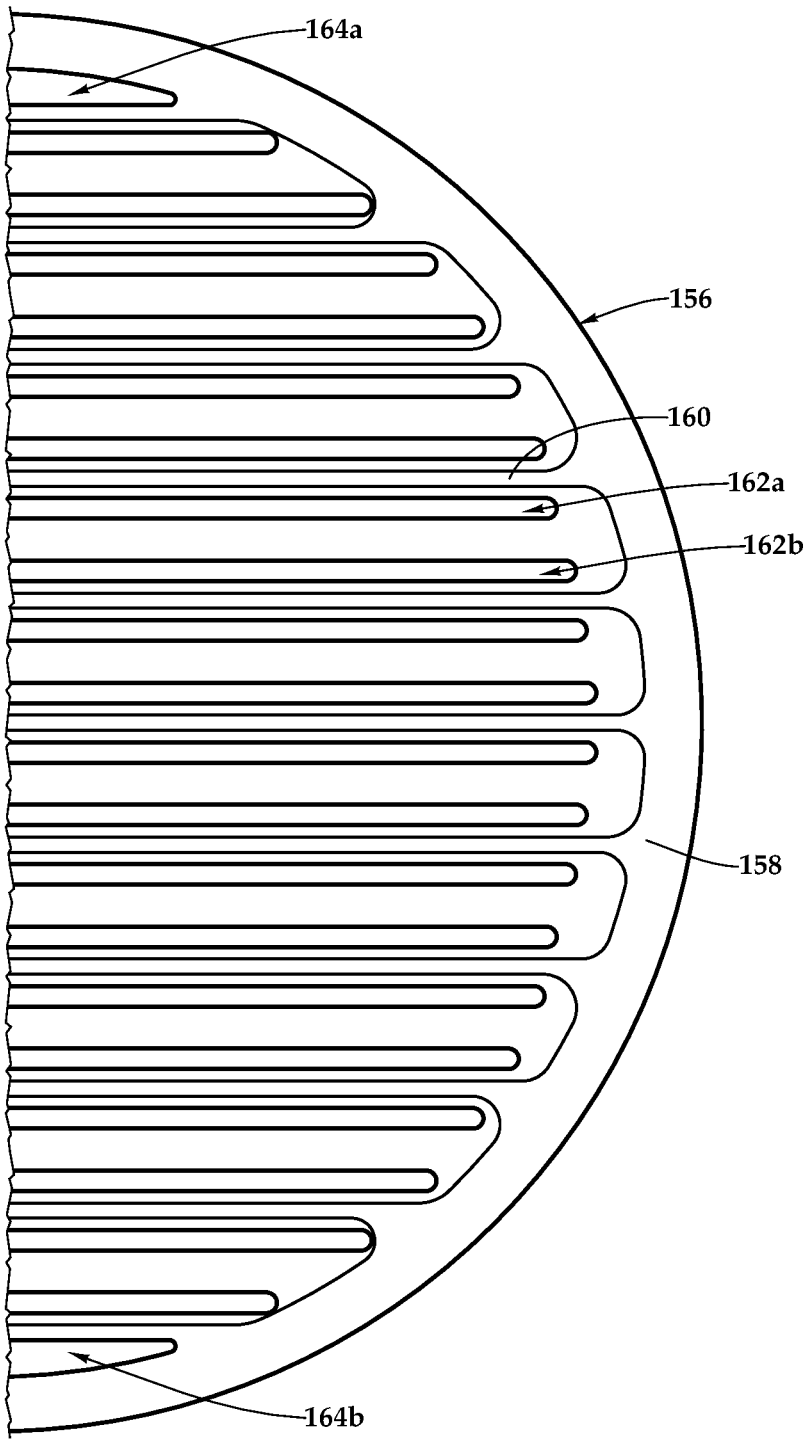
FIG. 9 is a plan view of a part of the paddle shown in FIGS. 2-5.

As shown in FIGS. 2 and 3, a segmented weir thief electrode assembly 52 is located near the top of the vessel frame 50. A paddle 54 may be provided in the vessel assembly 36 below the level of the segmented weir thief electrode assembly 52. Referring also to FIG. 9, in the example shown the paddle 54 is a paddle insert 156 having parallel spaced apart blades 160 extending across a paddle ring 158. The paddle insert 156 is attachable to a paddle frame 55 in the vessel frame 50. This allows the paddle insert to be more easily removed and replaced. A paddle actuator 56 on a vessel mounting plate 38 moves the paddle.

Figure 4:
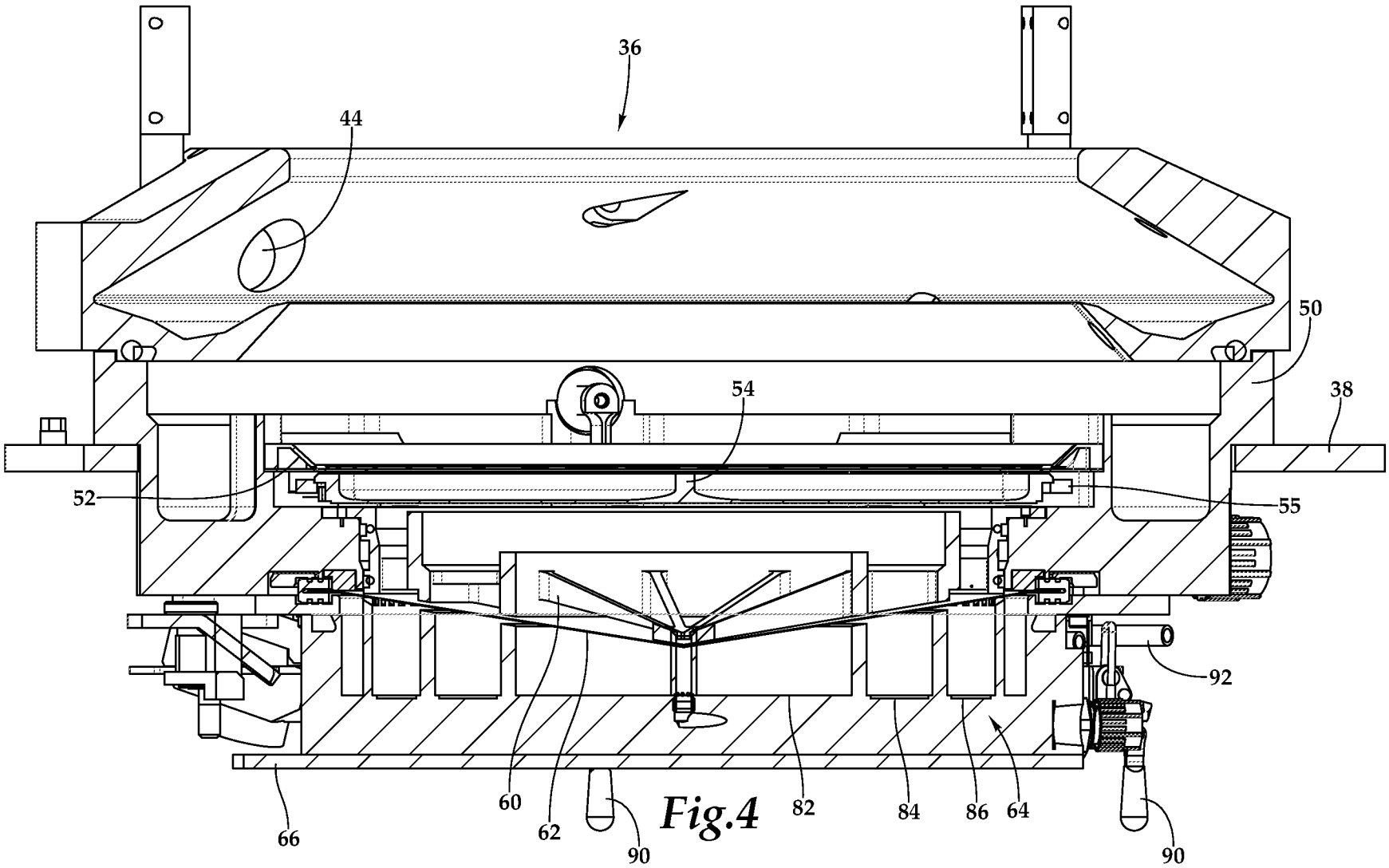
FIG. 4 is an orthogonal section view of the vessel assembly shown in FIGS. 2 and 3.

Turning to FIGS. 3 and 4, the vessel assembly 36 includes an anode assembly 64 having a lower cup 68 including a first ring 70, a second ring 72 and a third ring 74. These rings divide the anode assembly into a first or inner anode chamber 76, a second or middle anode chamber 78 and a third or outer anode chamber 80. First, second and third anode electrodes 82, 84 and 86 are positioned respectively at the bottom of the first, second and third anode chambers. Although various forms of anode electrodes may be used, in the example shown, each of the first, second and third anodes may be a flat metal ring. Each of the first, second and third anode electrodes is connected to a separately controllable power supply, or to a separate channel of a multichannel power supply 98 shown schematically in FIG. 3, to allow the electric current supplied by each anode to be independently controlled.

Referring still to FIGS. 3 and 4, in the anode assembly 64 the lower cup 68, made of a dielectric material, may be supported on a rigid metal base plate 66. Multiple latches 90 on the lower cup 68 or on the base plate 66 engage latch rings 92 on the vessel frame 50 or on the vessel mounting plate 38, to allow quick installation and removal of the anode assembly 64.

An upper cup 60, also made of a dielectric material, is positioned on top of the lower cup. The upper cup 60 has rings and chambers corresponding to, and aligned over the rings and chambers of the lower cup 68. A vessel membrane 62 between the lower cup 68 and the upper cup 60 passes electric current while preventing movement of electrolyte or particles. The upper cup 60 and the membrane 62 form a vessel or bowl for holding an electrolyte, specifically catholyte. The lower cup 68 holds a second electrolyte, specifically anolyte, separated from the catholyte by the membrane 62.

During processing, the paddle actuator 56 moves the paddle 54 to agitate the catholyte contained in the upper cup 60. The paddle moves back and forth within a paddle travel dimension, with an oscillating motion. For some applications the paddle may use other movements, such as start/stop, stagger, etc. The tiered drain rings in the rinse assembly 28, if used, are connected to drain and vacuum facilities via one or more the drain fittings 42 and aspiration fittings 44 shown in FIG. 2. The vessel assembly 36 may be mounted on the vessel mounting plate 38 to support the vessel assembly and other components and/or for alignment and positioning of the vessel assembly.

Referring to FIGS. 3 and 4, the vessel assembly 36 includes the anode assembly 64, the upper cup 60 and the segmented weir thief electrode assembly 52, which may be attached or supported directly or indirectly by the vessel frame 50. A weir overflow channel 58 in the vessel frame 50 connects to recirculation ports 57 which are connected to catholyte recirculation lines which may provide a continuous flow of catholyte through the upper cup 60 during processing and/or idle states.

Figure 5:
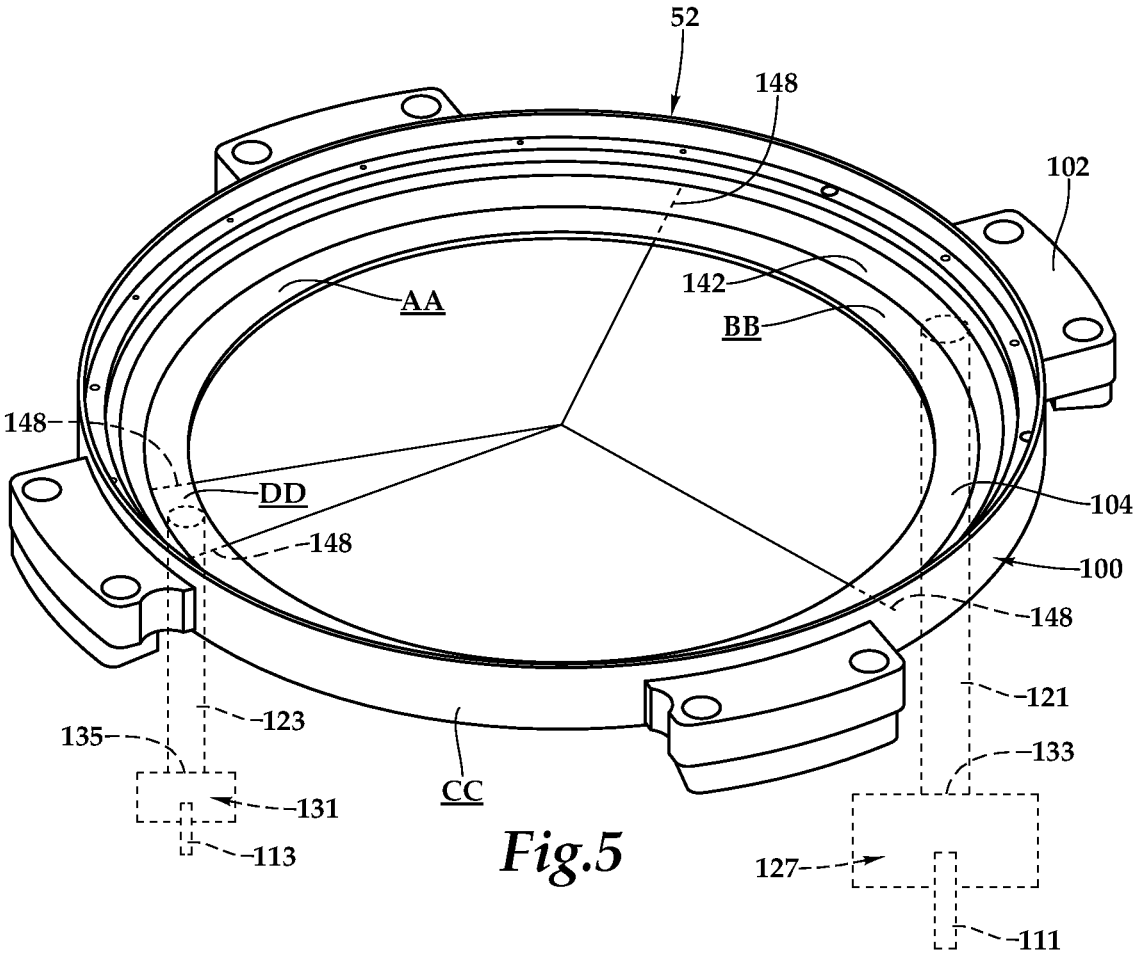
FIG. 5 is a top perspective view of the segmented weir thief electrode assembly shown in FIGS. 2-4.
Figure 6:
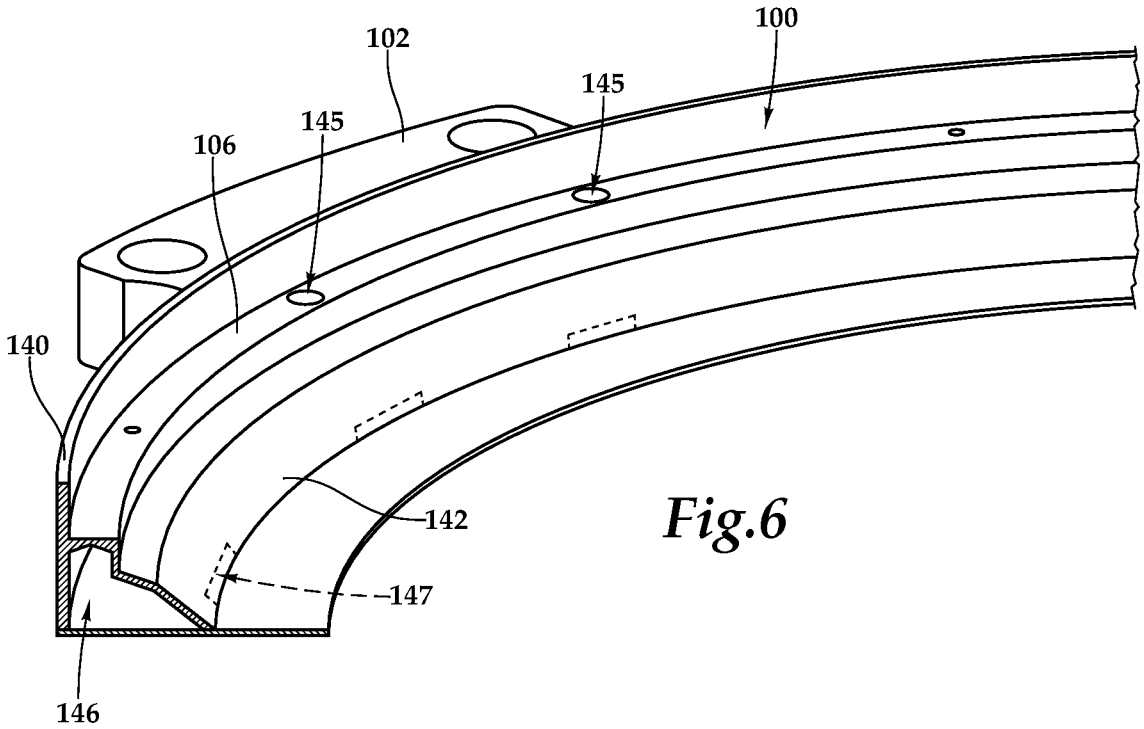
FIG. 6 is a perspective section view of the segmented weir thief electrode assembly shown in FIG. 5.

Turning to FIGS. 5 and 6, the segmented weir thief electrode assembly 52 may include a weir frame 100 attached to a flat weir ring 104, both made of a dielectric material. In the example shown the weir frame 100 is a circular ring having radially spaced apart lugs 102 for attaching the segmented weir thief electrode assembly 52 to the vessel frame 50. A cylindrical weir lip 140 on the weir frame 100 extends up may determine the level of catholyte in the upper cup 60. During certain process steps, catholyte may flow out of the upper cup 60 over the weir lip 140 and into the weir channel 58. As shown in FIG. 6 the weir frame 100 may have an angle section 142 extending up from the weir ring 104 adjoining a plane section 106 which may be perpendicular to the weir lip 140. A plenum 146 containing catholyte extends around inside of the weir frame 100. The plenum is divided into four virtual thief electrode segments by interior walls 148 shown by dotted lines in FIG. 5.

Referring still to FIG. 5, the four virtual thief electrode segments are labelled as AA, BB, CC and DD. The four segments are referred to as virtual thief electrode segments because they do not include a physical thief electrode. Rather, the physical thief electrodes associated with the virtual thief electrodes are located remotely from virtual thief electrode segments. Electrolyte in the vessel assembly provides a current flow path from the virtual thief electrode segments to the physical thief electrodes, as described below.

Segments AA and CC may both subtend a sector of 130 to 150 degrees and nominally 140 degrees. Segment BB may subtend a sector of 70 to 90 degrees and nominally 80 degrees. Segment DD is a local narrow sector subtending 1 to 15 degrees and nominally 10 degrees, and may be fit in between the ends of the two adjacent segments AA and CC.

Holes 145 through the plane section 106 are aligned on a diameter of the plenum which is greater than the inner diameter of the weir ring. The openings 145 allow the virtual thief electrode segments to influence the electric field in the vessel assembly primarily near the edges of the wafer, by providing a current flow pathway from the catholyte in the plenum 146 into the upper cup 60. Alternatively, slots 147 adjoining the weir ring 104 as shown in dotted lines in FIG. 6, may be used instead of the holes 145, although the slots are more susceptible to bubble trapping. The cross-sectional area of the plenum 146 may be maximized in order to increase minimum hole diameter or slot width, which simplifies manufacture of the segmented weir electrode thief. The holes 145 or slots 147 may be spaced apart at intervals of 15 to 25 degrees, or at 20 degrees. The hole diameters vary to provide uniform distribution of thief current in each segment.

For processing 300 mm wafers with plated areas extending out to 297 or 298 mm (i.e., within 1 or 1.5 mm of the wafer edge) the weir ring 104 may have an inside diameter of 298 mm. In the example shown, the seal on the contact ring in the head is at least two millimeters from the edge of the wafer and the first plated feature often begins even further in from the seal. Thus, the weir ring 104 does not reside beneath the plated film. It therefore does not interfere with the range of paddle movement or block mass transfer to the edge of the plated film. The weir ring 104 operates to direct flow rather than act as an electric field shield. For smaller wafers, or for wafers with all plated areas further in from the wafer edge, a weir ring 104 having a smaller inside diameter may be used.

Referring to FIGS. 3 and 5, four physical thief electrodes 110, 111, 112 and 113 and are provided in four thief electrode cups 125, 127, 129 and 131 attached to the bottom of the vessel frame 50 around the outside of the anode assembly 64. FIG. 3 shows the first physical thief electrode 110 and the third physical electrode 112 associated respectively with, and aligned vertically under, the first and third segments AA and CC. The second and fourth physical electrodes 111 and 113 shown schematically in FIG. 5 are similarly associated with and aligned vertically under the second and fourth segments BB and DD. Each physical electrode is electrically connected to a separate power supply channel by cables 115. A first thief electrolyte (first thiefolyte) is contained in a first chamber 124 in a first thief electrode cup 125 by a first thiefolyte membrane 130. The first thiefolyte is electrically in contact with the first thief electrode 110. A first thief electrode channel or passageway 120 filled with the catholyte extends up from the first thiefolyte membrane 130 into the plenum of the first segment AA of the segmented weir thief electrode assembly 52.

As also shown in FIG. 3, similarly, a third thief electrolyte (third thiefolyte) is contained in a third chamber 126 in a third thief electrode cup 127 by a third thiefolyte membrane 132. The third thiefolyte is electrically in contact with the third physical thief electrode 112. A third thief electrode channel or passageway 122 filled with the catholyte extends up from the third thiefolyte membrane 132 into the plenum of the third segment CC of the segmented weir thief electrode assembly 52.

Second and fourth thief electrolytes (second and fourth thiefolytes) are similarly contained in second and fourth chambers 127 and 131 in second and fourth electrode cups by second and fourth membranes 133 and 135 shown in FIG. 5. The second and fourth thiefolytes are electrically in contact with the second and fourth physical thief electrodes 111 and 113, respectively. Second and fourth thief electrode channels 121 and 123 filled with the catholyte extend up from the second and fourth thiefolyte membranes into the plenums of the second and fourth segments BB and DD of the segmented weir thief electrode assembly 52. The designs of the second and fourth virtual thief electrodes shown in FIG. 5 may be the same as the first and third virtual thief electrodes shown in FIG. 3, other than their sector angles. Thiefolyte chemistries may be common. In the example shown, the channels 120-123 may be centrally aligned underneath the lugs 102. Depending on the angles subtended by the segments, each channel 120-123 may or may not be centered in its respective segment.

The cross sections of the thief electrode channels 120-123 may also vary based on the current flow requirements of each segment. The diameter of the holes 145 or size of the slots 147 may increase with their distance from catholyte-filled channel providing current to the segment, so that the all of the holes or slots have largely equal influence on the electric field around the edge of pattern or plated metal 200A on the wafer 200, shown in FIG. 7.

All four thiefolytes may be the same. The vessel assembly 36 then contains three electrolytes: anolyte in the lower cup 68 of the anode assembly, catholyte in the upper cup 60, the plenum and the thief electrode channels 120-123, and thiefolyte in the thiefolyte chambers 124-127. In some embodiments the thiefolyte may be omitted and replaced with the catholyte. In this case the thiefolyte chambers 124-127 and channel membranes 130-133 may also be omitted. In some embodiments, the theifolyte may be replaced with anolyte.

Figure 7:
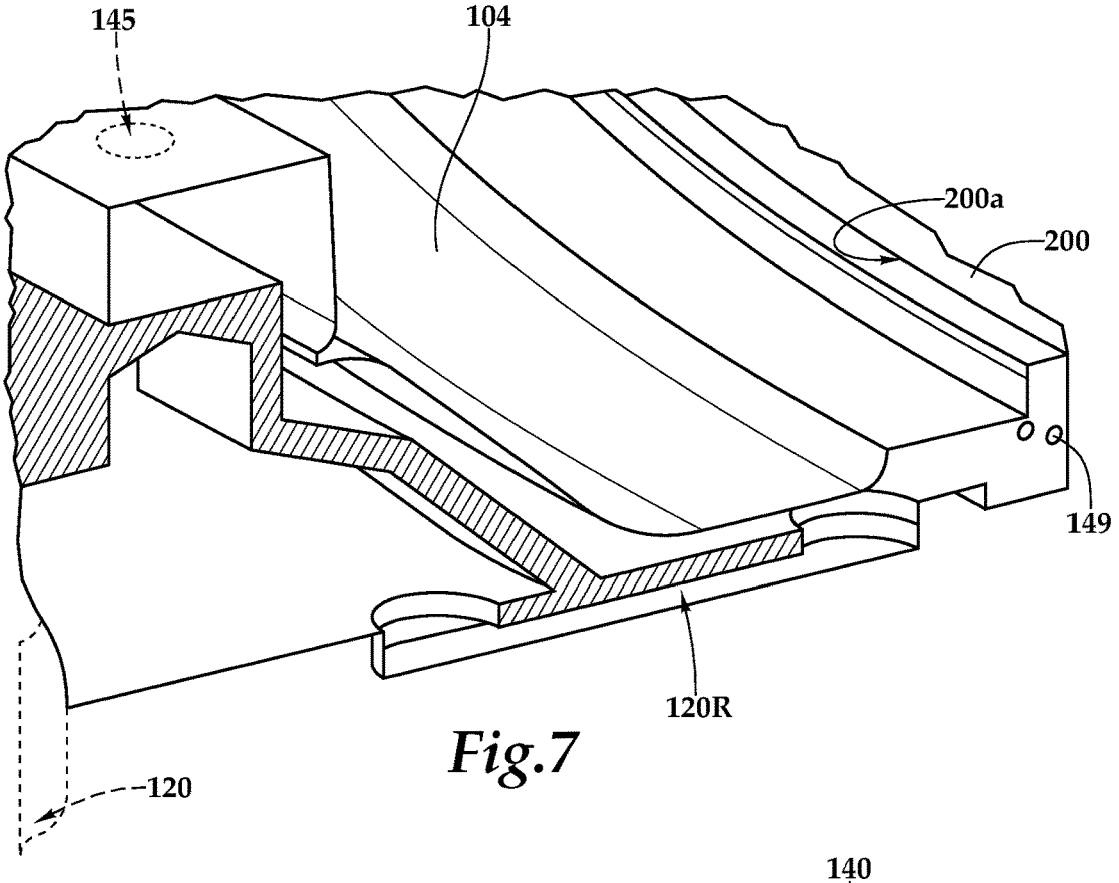
FIG. 7 is a partial perspective section view of an alternative segmented weir thief electrode assembly installed in the vessel assembly of FIGS. 2-5.

FIG. 7 shows an alternative segmented weir thief electrode assembly wherein the catholyte filled channels making up the virtual thief electrode has a radial portion 120R that extends radially inwardly, through or under the weir ring 104, so that it is closer to the edge of the wafer, relative to the holes 145 in the segmented weir thief electrode assembly shown in FIG. 5. This allows the virtual thief to exert greater influence on the electric field near the edge of the wafer. Virtual thief current requirements are also reduced and the effect of the virtual thief is more narrow, in contrast to the virtual thief segments AA, BB and CC of FIG. 5 where the effect of the virtual thief is more spread out across the wafer edge. The design in FIG. 7 may be used as a local virtual thief electrode (segment DD). The radial portion 120R may be used in place of the holes 145. In FIG. 7 cross-hatched areas indicate structure and white areas are electrolyte filled spaces. In an alternative design the radial portion 120R may lead to radial holes 149 in the weir shield. Two or three holes may be used having a hole diameter of 0.7 to 1.2 mm in the example shown.

Figure 8:
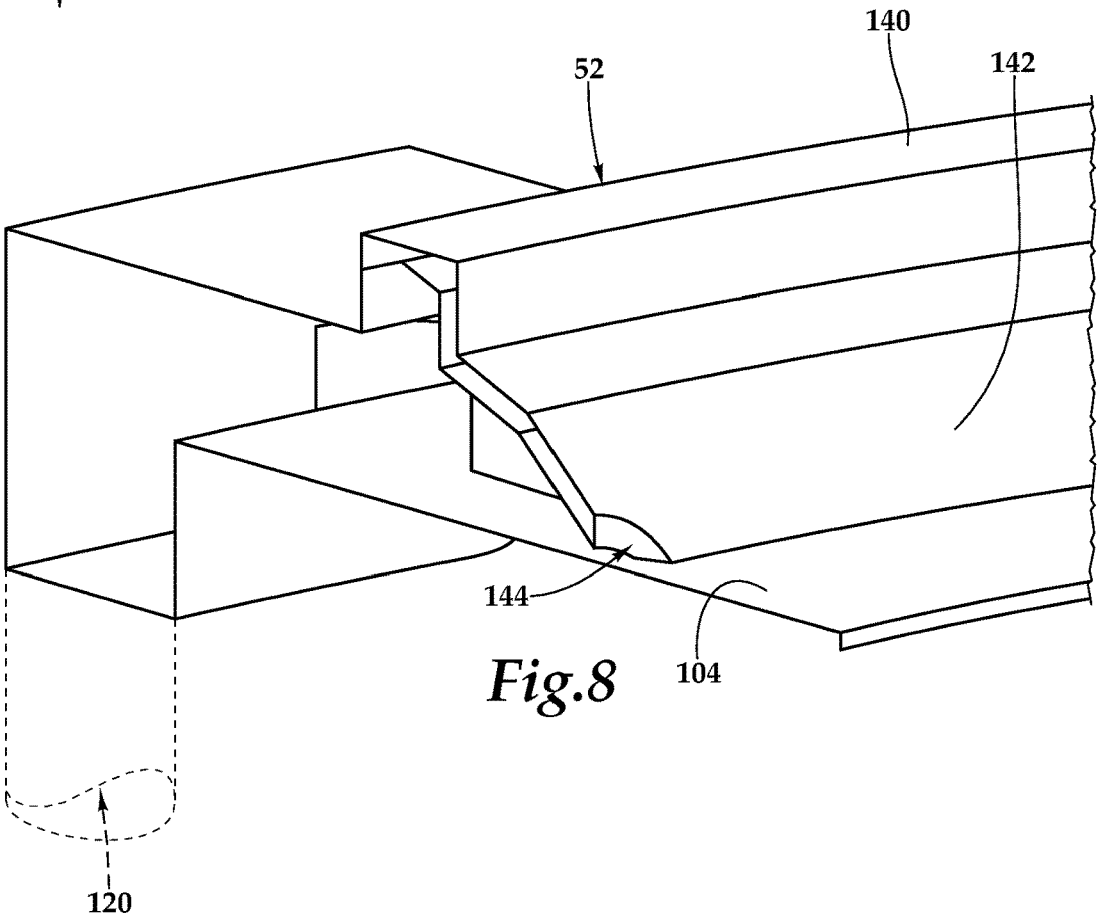
FIG. 8 is a partial perspective section view of yet another alternative segmented weir thief electrode assembly installed in the vessel assembly of FIGS. 2-5.

FIG. 8 shows an alternative segmented weir thief electrode assembly wherein an opening 144 is cut directly into the plenum to provide a path for a local thief current. Compared to the design in FIG. 7, manufacturing is simplified as the opening 144 can be readily cut with an end mill. This design is advantageously used in the local thief segment (segment DD) as it has a narrow focus well suited for compensating for local irregularities on the wafer, such as scribe area or a notch. It may be used for circumferential current adjustments near the irregularity, but has little or no effect on circumferential current distribution or circumferential uniformity over the rest of the wafer. If the wafer processed has no irregularity, the local thief segment may be switched off and not used.

In addition to the number and configuration of the segments shown in FIG. 5, other numbers and configurations of segments may be used. For example, a segmented weir thief electrode assembly may alternatively have two, three, five, six or more segments, each linked to a separate power supply channel. One alternative embodiment of the a segmented weir thief electrode assembly may have two local segments of 1 to 15 degrees separated by or between two segments of 165 to 179 degrees.

Turning to FIG. 9, the paddle 54, or the paddle insert 156, if used, may have two slots, 162A and 1628 between adjacent blades 160. The paddle 54 may also have end openings 164A and 1648 on opposite sides of the paddle, to reduce shielding at near the ends of the range of travel. The chord-shaped end openings are wider than the slots. In the example shown the blade height is 13 to 15 mm, or 14 mm, and the blade pitch is 29 to 33 mm, or 31 mm.

In use, a wafer having a metal seed layer is loaded into the rotor of the head 30. The lift/rotate 34 flips over and lowers the wafer into the vessel assembly 36 until at least the seed layer contacts the catholyte in the upper cup. The head 30 may rotate the wafer to even out uneven plating factors. The paddle actuator 56 moves the paddle 54 underneath the wafer. The power supply 98 provides specified time varying direct (positive) current independently to the first, second and third anodes, 82, 84 and 86 according to a preprogrammed schedule adapted to the specific wafer to be electroplated.

The power supply 98 also provides specified time varying direct (negative) current independently to the first, second, third and fourth physical current thief electrodes, which current flows through the thiefolytes and the catholyte in thief channels of the first, second, third and fourth virtual electrodes. Each virtual thief segment distributes the current circumferentially through a set of variable-sized openings, which may be holes or slots 144 or 145. Catholyte from inlets into the thief channels 120-123, above the thief membranes, flows into the plenum 146 and out the holes 145 in the top of the plenum. Use of the up-facing holes 145 allows trapped bubbles in the catholyte to escape from the plenum 146.

Since current density across the wafer may be controlled by adjusting the current of the anodes and the virtual current thieves, the system 20 can better process wafers over a range of parameters, without the need to replacing fixed shields in the vessel assembly 36, which is a time consuming process. The system 20 can also provide good performance of the entire process via current control.

The design of the virtual thief electrodes forces thief current to pass between lower surfaces of the contact ring in the head and the top surface of the weir ring 104. This causes the effect of the segments AA, BB, CC and DD to be focused near the edge 200A of the wafer 200 shown in FIG. 7. As a result, required thief currents are lower and more focused control over the electric field at the edge of the wafer is provided. Since the thief currents are relatively low, unlike many known systems, the system 20 can continuously process large numbers of wafers without causing the physical thief electrodes to plate up and become inoperable.

Radial current density control and circumferential current density control may be achieved by adjusting anode and thief currents. Measurements of plating thickness of prior wafer can be used to adjust these currents. Initial currents can be set from a model that uses process conditions as inputs (e,g., bath conductivity of anolyte and catholyte, wafer current, seed resistance, pattern open area, pattern edge exclusion, pattern feature sizes, and intended plating thickness).

The current or voltage supplied by the power supply 98 to each thief segment is independently controlled, for example with a current in the range of 10 mA to 5A, a current rise time of 100 mS or less, and voltages of −0V to −60V. Current and/or voltage control may be synchronized with wafer position (via control of the motor in the head spinning the rotor) to enable precise circumferential uniformity control of the electroplating at the edge of the wafer. The wafer position may vary with a continuous wafer rotation. The wafer position may include pauses at fixed wafer angular positions or include changes in wafer rotational speed. The current and/or voltage may increase or decrease in time according to wafer position and angular rotation speed. The current and/or voltage may increase or decrease in time according to wafer position and angular rotation speed and based upon deposition thickness measurements of a prior wafer (i.e. feedback control). The current and/or voltage may increase or decrease in time according to wafer position and angular rotation speed and based upon a model or measurements of the local edge pattern density.

The virtual anode channels 120, 121, 122 and 123 extend across the membrane 62, which separates the anolyte from the catholyte. This design is more tolerant of anode current leaks between channels because the anode currents do not approach zero for expected process conditions. This allows introduction of gaps below the membrane 62 at each dividing wall to allow bubbles to pass. Gaps allow current to pass between channels, but these current leaks are small enough that the anode currents can be adjusted to compensate.

The specific details of particular embodiments may be combined in any suitable manner without departing from the spirit and scope of embodiments of the invention. However, other embodiments of the invention may be directed to specific embodiments relating to each individual aspect, or specific combinations of these individual aspects.

The above description of example embodiments of the invention has been presented for the purposes of illustration and description. It is not intended to be exhaustive or to limit the invention to the precise form described, and many modifications and variations are possible in light of the teaching above. Numerous details have been set forth in order to provide an understanding of various embodiments of the present technology. It will be apparent to one skilled in the art, however, that certain embodiments may be practiced without some of these details, or with additional details.

Having described several embodiments, it will be recognized by those of skill in the art that various modifications, alternative constructions, and equivalents may be used without departing from the spirit of the invention. Additionally, a number of well-known processes and elements have not been described in order to avoid unnecessarily obscuring the present invention. Additionally, details of any specific embodiment may not always be present in variations of that embodiment or may be added to other embodiments.

Where a range of values is provided, it is understood that each intervening value, to the tenth of the unit of the lower limit unless the context clearly dictates otherwise, between the upper and lower limits of that range is also specifically disclosed. Each smaller range between any stated value or intervening value in a stated range and any other stated or intervening value in that stated range is encompassed. The upper and lower limits of these smaller ranges may independently be included or excluded in the range, and each range where either, neither, or both limits are included in the smaller ranges is also encompassed within the invention, subject to any specifically excluded limit in the stated range. Where the stated range includes one or both of the limits, ranges excluding either or both of those included limits are also included.

The term "wafer" includes silicon wafers as well as other substrates on which micro-scale features are formed. As used herein and in the appended claims, the singular forms "a", "an", and "the" include plural referents unless the context clearly dictates otherwise. The terms above or below refer to the direction of gravity with the apparatus in its customary orientation. The invention has now been described in detail for the purposes of clarity and understanding. However, it will be appreciated that certain changes and modifications may be practice within the scope of the appended claims.

The invention claimed is:

1. An electroplating system, comprising:

a vessel assembly;

a weir thief electrode assembly in the vessel assembly, the weir thief electrode assembly including a plenum inside of a weir frame, the weir thief electrode assembly having at least first, second, third and fourth virtual thief electrode segments, the first, the second and the third virtual thief electrode segments subtending an angle greater than the fourth virtual thief electrode segment;

a plurality of spaced apart openings through the weir frame into the plenum;

a weir ring attached to the weir frame; and at least first, second, third and fourth physical thief electrodes electrically connected to first, second, third and fourth independently controllable power supply sources, respectively, the first, second, third and fourth physical thief electrodes in electrical continuity with the first, second, third and fourth virtual thief electrode segments, respectively.

2. The electroplating system of claim 1 with the weir frame further including an angle section extending from the weir ring towards a plane section, and the plurality of spaced apart openings in the plane section.

3. The electroplating system of claim 2 further including a cylindrical weir lip on the weir frame, the plane section perpendicular to the weir ring and the plurality of openings centered on a diameter greater than an inner diameter of the weir ring.

4. The electroplating system of claim 1 wherein the vessel assembly includes a vessel frame, and the first, the second, the third and the fourth physical thief electrodes are supported on the vessel frame at a vertical position below the weir ring.

5. The electroplating system of claim 1 further including a first thief channel, a second thief channel, a third thief channel and a fourth thief channel in the vessel assembly extending respectively, from first, second, third and fourth chambers containing the first, the second, the third and the fourth physical thief electrodes, to the plenum.

6. The electroplating system of claim 5 further including a first electrolyte in an electrolyte vessel in the vessel assembly, a thief channel membrane in each thief channel, a chamber containing a second electrolyte below each thief channel membrane, the second electrolyte in each chamber in contact with one of the physical thief electrodes.

7. The electroplating system of claim 1 wherein the vessel assembly includes an electrolyte vessel below the weir thief electrode assembly and an electrolyte and a paddle in the electrolyte vessel, the paddle attached to a paddle actuator, for agitating the electrolyte.

8. The electroplating system of claim 1 wherein the first and the third virtual thief electrode segments subtend an angle of 130 to 150 degrees and the second virtual thief electrode segment subtends an angle of 70 to 90 degrees.

9. An electroplating system, comprising:

a vessel assembly including a lower cup and an upper cup on top of the lower cup;

a vessel membrane between the lower cup and the upper cup;

a paddle above the upper cup connected to a paddle actuator for moving the paddle;

a weir thief electrode assembly in the vessel assembly above the paddle, the weir thief electrode assembly including a weir frame having a plenum divided into first, second, third and fourth virtual thief electrode segments, the first, the second and the third virtual thief electrode segments subtending an angle greater than the fourth virtual thief electrode segment;

a plurality of spaced apart openings in the weir frame; and first, second, third and fourth physical thief electrodes electrically connected to first, second, third and fourth independently controllable power supply sources, respectively, the first, second, third and fourth physical thief electrodes in electrical continuity with the first, second, third and fourth virtual thief electrode segments, respectively.

10. The electroplating system of claim 9 wherein the first, the second, the third, and the fourth physical thief electrodes are at a vertical position below the paddle and are electrically continuous with the first, the second, the third and the fourth virtual thief electrode segments via a first, a second, a third and a fourth thief channel in the vessel assembly extending respectively from the first, the second, the third and the fourth physical thief electrodes to the plenum, at least part of the first, the second, the third and the fourth thief channels filled with an electrolyte.

11. The electroplating system of claim 9 wherein the paddle comprises a plurality of parallel spaced apart blades and a first slot and a second slot between adjacent blades.

12. The electroplating system of claim 9 with the paddle further including chord shaped openings at opposite sides of the paddle.

13. The electroplating system of claim 10 wherein the first and the third virtual thief electrode segments subtend an angle of 130 to 150 degrees, the second virtual thief electrode segment subtends an angle of 70 to 90 degrees.

14. The electroplating system of claim 9 further including a flat weir ring attached to the weir frame and a cylindrical weir lip on the weir frame perpendicular to the weir ring.

15. The electroplating system of claim 14 wherein the paddle moves within a travel dimension and the weir ring has an inside diameter greater than travel dimension.

16. The electroplating system of claim 14 wherein one or more of the virtual thief electrode segments has a radial portion extending inwardly through or under the weir ring.

17. An electroplating system, comprising:

a vessel assembly including a lower cup in an anode assembly and an upper cup on top of the lower cup;

a vessel membrane between the lower cup and the upper cup;

a paddle above the upper cup connected to a paddle actuator for moving the paddle;

a weir thief electrode assembly in the vessel assembly above the paddle, the weir thief electrode assembly including a weir frame having a plenum divided into a first virtual thief electrode segment, a second virtual thief electrode segment, a third virtual thief electrode segment and a fourth virtual thief electrode segment, the first, second, third and fourth virtual thief electrode segments comprising first, second, third and fourth chambers separated by interior walls;

the first, the second and the third virtual thief electrode segments subtending an angle greater than the fourth virtual thief electrode segment;

a plurality of spaced apart openings in the weir frame leading into the plenum;

a first physical thief electrode, a second physical thief electrode, a third physical thief electrode and a fourth physical thief electrode in electrical continuity with the first, the second, third and fourth virtual thief electrode segments, respectively, the first, the second, the third and the fourth physical thief electrodes electrically connected to a first separately controllable power supply source, a second separately controllable power supply source, a third separately controllable power supply source and a fourth separately controllable power supply source, respectively;

wherein the first, the second, the third and the fourth physical thief electrodes are below the paddle and are electrically continuous with the first, the second, the third and the fourth thief electrode segments via thief channels in the vessel assembly extending respectively from the first, the second, the third and the fourth physical thief electrodes to the plenum, and at least part of each thief channel is filled with a first electrolyte; and a thief channel membrane in each thief channel, each thief channel membrane separating the first electrolyte from a second electrolyte below the membrane, and the first, the second, the third and the fourth physical thief electrodes in contact with the second electrolyte.

* * * * *